US006341860B1

(12) United States Patent
Harris

(10) Patent No.: US 6,341,860 B1
(45) Date of Patent: Jan. 29, 2002

(54) DUPLEX DOCUMENT PRINTER MECHANISM

(75) Inventor: Richard Hunter Harris, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/260,842

(22) Filed: Mar. 2, 1999

(51) Int. Cl.[7] ..... B41J 2/01
(52) U.S. Cl. ..... 347/103; 400/188; 347/213
(58) Field of Search ..... 347/103, 213, 347/101, 104, 105, 215, 217; 400/188, 189, 264, 266

(56) References Cited

U.S. PATENT DOCUMENTS 4,538,156 A * 8/1985 Durkee et al. ..... 346/21
4,755,071 A 7/1988 Kato ..... 400/188
5,099,256 A * 3/1992 Anderson ..... 347/103
5,365,261 A 11/1994 Ozawa ..... 347/103
5,623,296 A 4/1997 Fujino ..... 347/103
5,677,719 A * 10/1997 Granzow ..... 347/103
5,899,615 A * 5/1999 Sansone ..... 400/188

* cited by examiner

*Primary Examiner*—John S. Hilten
*Assistant Examiner*—Minh H. Chau
(74) *Attorney, Agent, or Firm*—J. Bruce Schelkopf; Winstead, Sechrest & Minick, LLP

(57) ABSTRACT

A printing apparatus and a method suitable for printing on two sides of medium, such as paper by using an intermediate transfer surface. The device consists of a print head, an intermediate transfer surface and a medium path such that as the medium is transported along the medium path the print head prints a first image on the transfer surface, then sequentially prints a second image to one face of medium while the transfer surface is transferring the first image to the other face of a medium by pressing the transfer surface against the medium. A method for printing is also disclosed comprising of the steps of printing a first image on a transfer surface, printing a second image directly onto one face of the medium, then transferring the first image onto the other face of the medium.

28 Claims, 3 Drawing Sheets

DUPLEX DOCUMENT PRINTER MECHANISM

TECHNICAL FIELD

The invention relates in general to electronic printers and copiers, and in particular to printers and copiers where both the front and back surface of a paper document are to be printed.

BACKGROUND INFORMATION

When using electronic cash registers and point of sale printers, it is often necessary to print on the front and back surface of a document, such as a check. This is sometimes accomplished by a salesperson physically inserting a check into the path of a print head so that one side can be printed, removing the check, turning it around and reinserting the other side of the check so the other side can be printed. This procedure is time consuming and often the sales person inserts the wrong side of the document into the path of the printer head.

Some cash registers and point of sale printers, known as "duplex printers" are capable of printing on both sides of a document without the need for human intervention. Depending on the design scheme, duplex printers use one or multiple print stations. Duplex printers that use a single printer station physically turn the document so that printing occurs sequentially on both surfaces of the document. A turning mechanism must be supplied to turn or flip the document. Such a mechanism was disclosed in U.S. Pat. No. 5,865,547, issued Feb. 2, 1999 to Harris. These mechanisms are relatively more expensive. Furthermore, turning or flipping the document greatly increases the probability that a paper jam will occur. As such, these mechanisms often have relatively higher maintenance costs.

Another approach is the use of two print stations. However, the cost of the printer or register is significantly increased because the print station is typically one of the more expensive parts of the printer. Furthermore, the use of two print stations increases the overall failure rate of the printer and increases maintenance costs.

What is needed, therefore, is a device which economically and reliably allows printing on both sides of a document without the use of a turning mechanism or two printer stations.

SUMMARY OF THE INVENTION

The previously mentioned needs are fulfilled with the principle of the present invention. Accordingly, there is provided, in a first form of the present invention a printing apparatus consisting of a print head, a transfer surface and a medium path such that as the medium is transported along the medium path the print head prints a first image on the transfer surface, then sequentially prints a second image to one face of a medium while the transfer surface is transferring the first image to the other face of the medium by pressing the transfer surface against the medium.

A method for printing is also disclosed comprising the steps of printing a first image on a transfer surface, printing a second image directly onto one face of the medium, then transferring the first image onto the other face of the medium.

These and other features, and advantages, will be more clearly understood from the following detailed description taken in conjunction with the accompanying drawings. It is important to note the drawings are not intended to represent the only form of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
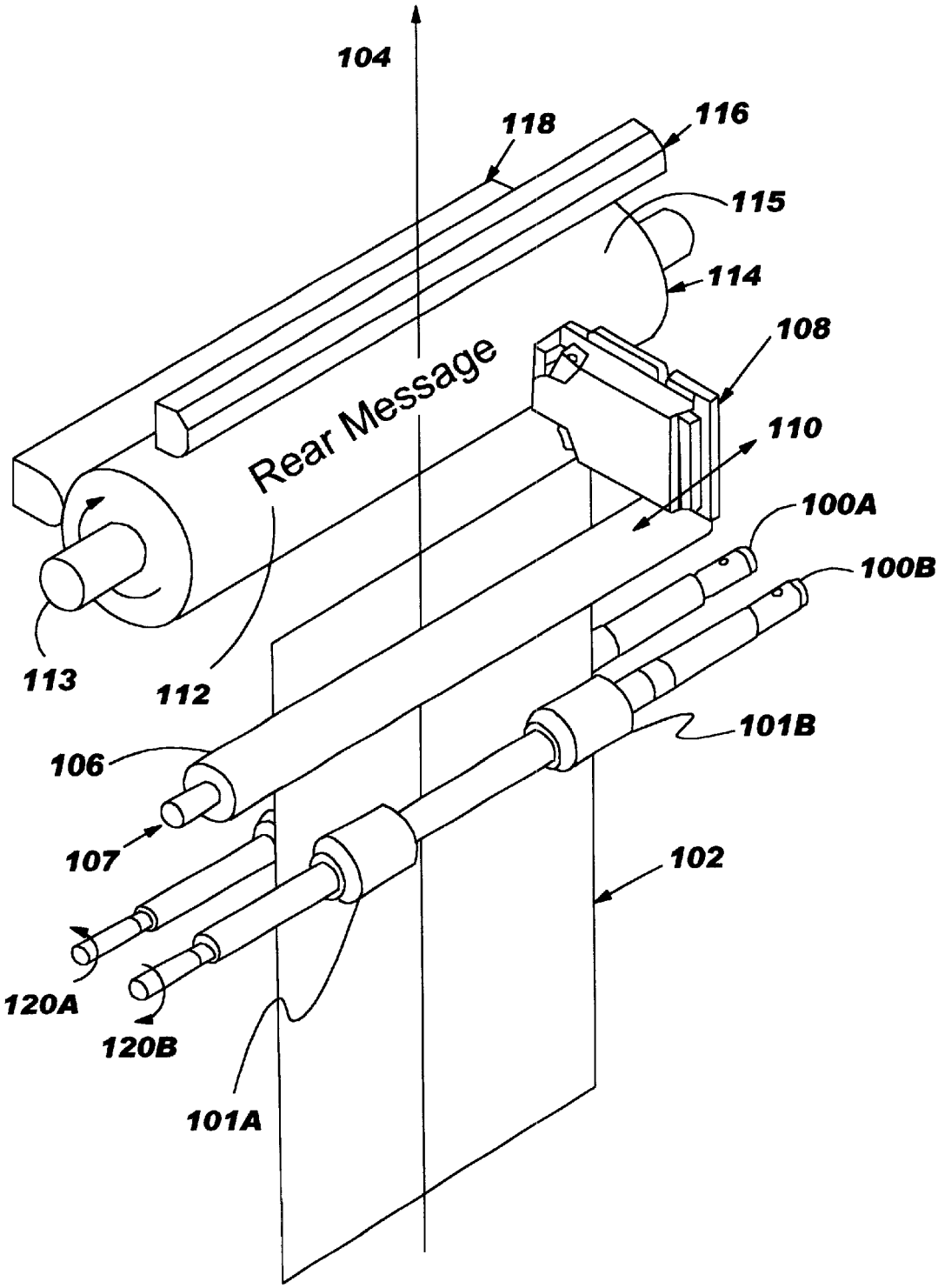
FIG. 1 is an isometric view of one embodiment of the present invention as shown used in a point of sale printer during one stage of the print cycle.
Figure 2:
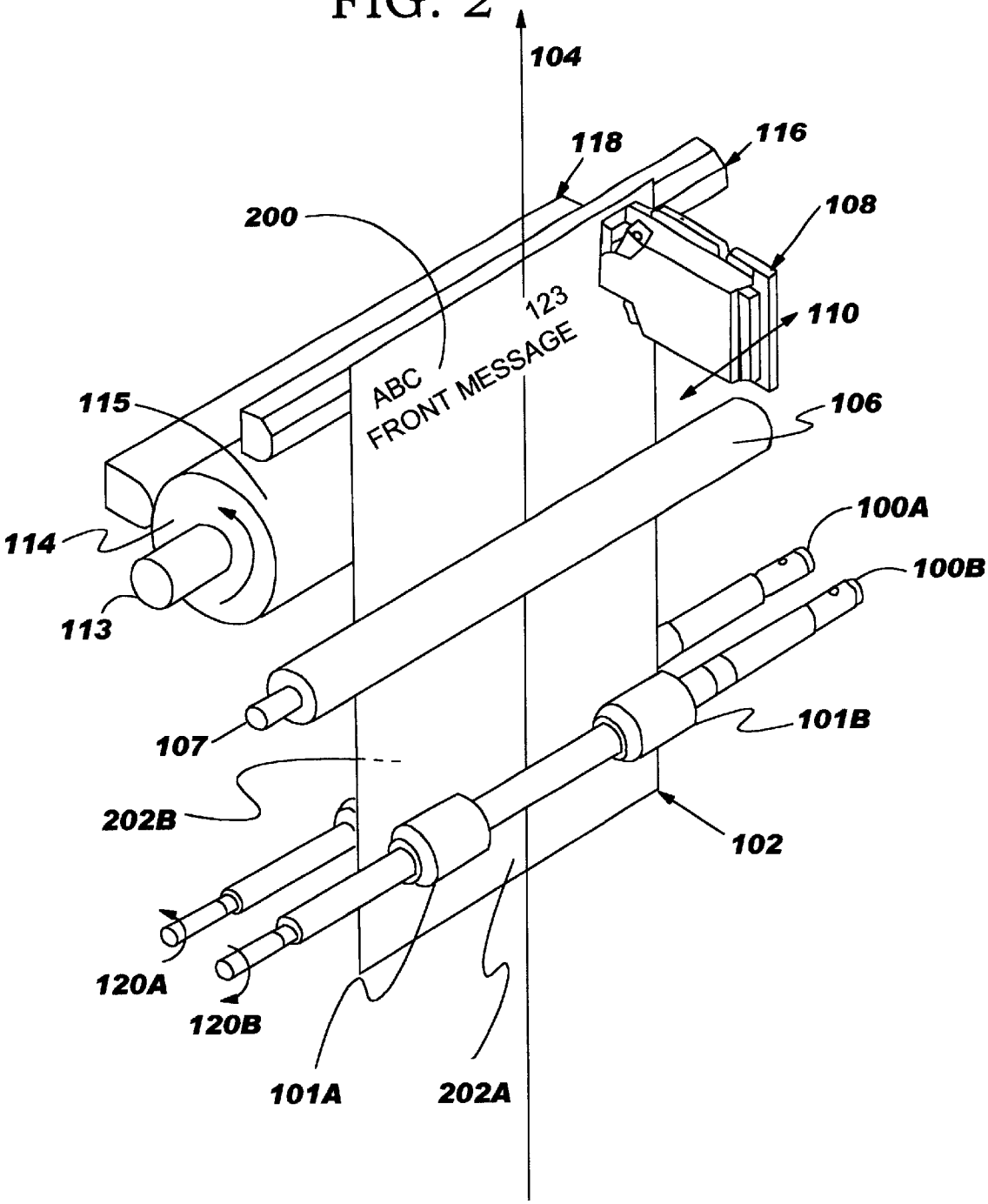
FIG. 2 is an isometric view of the embodiment of FIG. 1 showing another stage of the print cycle.
Figure 3:
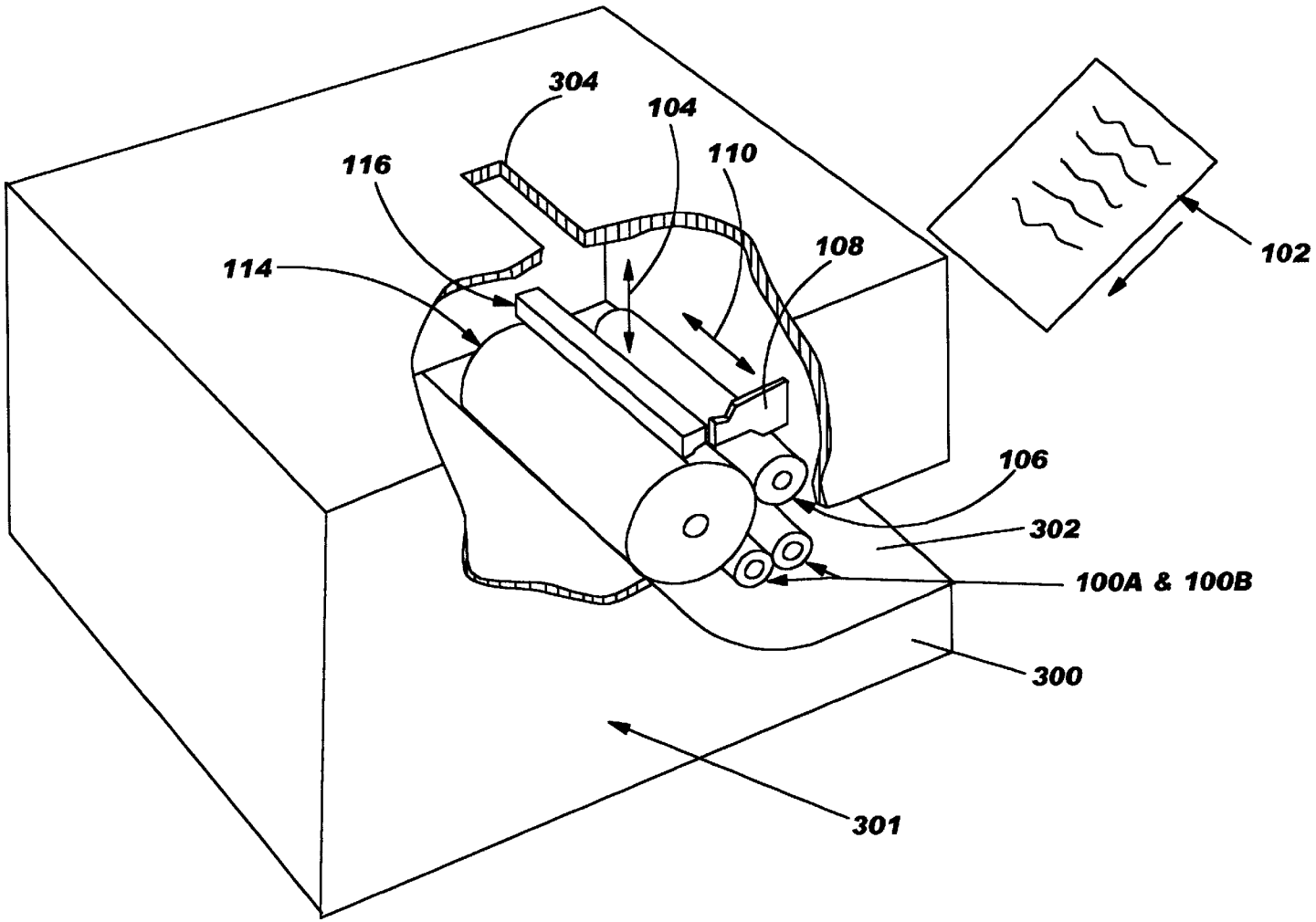
FIG. 3 is an isometric view of the embodiment of FIG. 1 used in a point of sale printer.

The principles of the present invention and their advantages are best understood by referring to the illustrated embodiment depicted in FIGS. 1–3 of the drawings, in which like numbers designate like parts. In the following description, well-known elements are presented without detailed description in order not to obscure the present invention in unnecessary detail. For the most part, details unnecessary to obtain a complete understanding of the present invention have been omitted inasmuch as such details are within the skills of persons of ordinary skill in the relevant art. Details regarding control circuitry or mechanisms used to control the rotation of the various elements described herein are omitted, as such control circuits are within the skills of persons of ordinary skill in the relevant art.

FIG. 1 illustrates an embodiment of the present invention as used in a point of sale printer. Other embodiments could include copiers, computer printers or fax machines. The printer housing and supports have been removed to illustrate interior detail and a portion of the elements of the present invention. In this embodiment, a recording medium, such as a check, or paper 102 is to receive the printed images. However, the medium could consist of plastic, paper or another suitable material. FIG. 1 shows paper 102 sandwiched between feed rollers 100A and 100B. Feed rollers 100A and 100B are elongated cylindrical shafts each having two sets of paper rollers. One set of paper rollers 101A and 101B are visible in FIG. 1. Paper rollers 101A and 101B are cylindrical rollers made of rubber or other materials which have a high coefficient of friction. A relatively high coefficient of friction is necessary so that paper 102 will move along paper path 104 as feed rollers 100A and 100B rotate. Paper path 104 is the route or direction paper 102 takes as it is moved through the present invention and the printer. In this embodiment, it is the route the paper takes from the time it enters slot 302 (see FIG. 3) to the time it exits slot 304 (see FIG. 3).

Pressure roller 106 is further along paper path 104 from feed rollers 100A and 100B. Pressure roller 106 is a cylinder made of rubber or another elastic material capable of deforming in such a way that it exerts a relatively uniform pressure in response to a pressure applied to its surface. Pressure roller 106 is rotationally mounted to shaft 107 which is rotatably attached to fixed supports (not shown) in the printer housing 301 (See FIG. 3). Further along paper path 104 from pressure roller 106 is a print head 108. In this embodiment, another stepper motor and gearing (not shown) moves print head 108 back and forth in a direction parallel to direction 110. Direction 110 is substantially perpendicular to the direction of paper path 104. Print head 108 is illustrated as an ink jet print head. A print head is the part of a printer that controls the printing of characters or images on paper. An ink jet print head is of the type which prints an image by ejecting ink droplets from a plurality of nozzles in response to a recording signal. In other embodiments, print head 108 could be any print head capable of printing on transfer surface 115 and paper 102. Such print heads include laser print heads, thermal transfer print heads, in-line ink jet print heads. A laser print head uses electrophotographic technology similar to technology used in by photocopiers. Thermal transfer print include print heads which use heat to generate an image on a specially treated surface and print heads which use heat to melt colored wax onto paper to create an image. An in-line ink jet print head has hundreds of nozzles that span the width of paper 102 and would eliminate the need to move the print head across the paper path. These print heads are familiar to those who are in the art of designing electronic printers.

In FIG. 1, print head 108 is positioned to print a reverse image 112 on transfer roller 114. A positioning assembly consisting of a series of rollers, gearing, and supports (not shown) positions transfer roller 114 so that it is in apposition to print head 108. It also positions pressure roller 106 and platen 116. Such positioning assembles are known to those in the art of designing electronic printers. Transfer roller 114 is cylindrical in shape and comprises a transfer surface 115 and an internal drum rotatably mounted on a support shaft 113 which is secured to the positioning assembly (not shown). Surface 115 is made from stainless steel or similar material that does not absorb or disperse the ink from print head 108. Downstream of transfer roller 114 and further along paper path 104 is platen 116. Platen 116 is made of material capable of supporting the back surface of paper 102 when print head 108 is printing an image 200 on the front surface 202A of paper 102 (See FIG. 2). Transfer roller cleaning station 118 is partially shown in FIG. 1 behind transfer roller 114.

FIG. 2 shows paper 102 at a different point further along paper path 104. FIG. 2 also shows the relative positions after the positioning assembly has positioned pressure roller 106, transfer roller 114, and platen 116. In FIG. 2, pressure roller 106 is now in apposition to transfer roller 114 such that paper 102 is sandwiched between transfer roller surface 115 and the surface of pressure roller 106. Platen 116 has also been positioned such that it is in apposition to print head 108. At this point, print head 108 can now print image 200 directly on face 202A of paper 102.

FIG. 3 shows the embodiment of FIGS. 1 and 2 as part of a point of sale printer 300. A portion of the walls of printer housing 301 have been removed to illustrate interior detail and configuration of some of the elements of the present invention. For brevity and clarity, a description of those parts which are identical or similar to those described in connection with the first embodiment illustrated in FIGS. 3 and 4 will not be repeated here. Paper 102 is shown before it enters slot 302 of printer housing 301. After paper 102 follows paper path 104 (FIGS. 1 and 2) it will exit from slot 304. Slot 304 is only partially shown because the walls of printer housing 301 have been removed.

OPERATION

The manner of using the duplex printer mechanism can be illustrated by describing it as a part of a point of sale printer. A document, such as a check or paper 102 is partially inserted into the printer slot 302 (see FIG. 3). The printer housing 301 is used as a guide to position paper 102 in the space defined between rollers 100A and rollers 100B. A sensor (not shown) activates a circuit which drives a document feed mechanism (not shown). Rotation and torque from the document feed mechanism is transmitted by gearing (not shown) to feed rollers 100A and 100B.

FIG. 1 illustrates the relative position of platen 116, print head 108, transfer roller 114, and pressure roller 106 after image 112 is printed onto surface 115. Feed roller 100A rotates counter-clockwise about its longitudinal axis as viewed from FIG. 1 in direction 120A. Feed roller 100B rotates clockwise about its longitudinal axis as viewed from FIG. 1 in direction 120B. The combined rotation of feed rollers 100A and 100B moves paper 102 along paper path 104. The check verification information is then printed as reverse image 112 onto surface 115 of transfer roller 114 by print head 108. An elongated piece of image 112 which is parallel to direction 110 or "row" of information is printed as print head 108 moves in a direction substantially parallel to direction 110. After a row of information is printed, transfer roller 114 is rotated in a clockwise direction about its longitudinal axis as viewed from FIG. 1. After transfer roller 114 is rotated, another row of information is printed onto surface 115 as print head 108 moves back across transfer roller 114. This cycle of printing and clockwise rotating continues until all of image 112 is printed onto surface 115. The circumference of transfer roller 114 must be slightly larger than the number of rows necessary to complete the printing of the image.

In FIG. 2, the positioning assembly (not shown) has moved transfer roller 114 adjacent to pressure roller 106. Platen 116 has been positioned such that platen 116 is in apposition to the path of print head 108 and paper 102 is between platen 116 and print head 108. In another embodiment, for example, platen 116 and transfer roller 114 could remain stationary while the positioning system moves print head 108 and pressure roller 106. The position system consists of gearing and guides (not shown, but familiar to those who are in the art of designing electronic printers).

Pressure roller 106 has been positioned such that it is adjacent to transfer roller 114 and paper 102 is sandwiched between transfer roller 114 and pressure roller 106. The pressing of surface 115 against the surface of pressure roller 16 creates an elongated area of pressure. Transfer roller 114 rotates counterclockwise about its longitudinal axis when viewed from FIG. 2 while pressure roller 106 turns clockwise. The pressure between the two surfaces is sufficient to cause image 112 (see FIG. 1) to be pressed onto surface 202B of paper 102 such that image 112 is entirely transferred off from transfer surface 115 to paper 102 as the pressure roller 106 and transfer roller 114 rotate.

Furthermore, as paper 102 moves between platen 116 and print head 108, print head 108 prints ink on surface 202A as image 200. A part of image 200 consisting of a row of information is printed as print head 108 moves forward in a direction substantially parallel to direction 110. After a row of information is printed, paper 102 is moved in a direction substantially parallel to direction 104 by feed rollers 100A and 100B and by the rotation of transfer roller 114 pressing against pressure roller 106. After paper 102 is moved, another row of information is printed onto surface 202A as print head 108 moves back across platen 116. This cycle of rotation and printing continues until all of image 200 is printed.

After the ink on surface 115 of transfer roller 114 has been transferred to paper 102, surface 115 rotates to cleaning station 118. Cleaning station 118 removes any residue left from image 112 on surface 115. One embodiment of cleaning station 118 consists of a solvent and ink adsorbing roller or similar device in combination with an elastic blade or body of rubber or the like with is pressed against transfer surface 115. Such blades and cleaning stations are familiar to those who are in the art of designing electronic printers.

Unlike the arrangements of the related art that use a paper turning mechanism, the present invention prints on both sides of the paper without turning the paper. Because paper turning mechanisms often jam, the present invention is more reliable, resulting in lower maintenance costs. Furthermore, the present invention uses only one print head and print station in contrast to related art that use two print heads and two printer stations. The printer stations are often the most expensive parts of a printer, thus, the use of a single print station results in a more economical and reliable design.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It is therefore, contemplated that the claims will cover any such modifications or embodiments that fall within the true scope of the invention.

What is claimed is:

1. A printing apparatus comprising:

a print head responsive to digital signals;

a transfer surface positioned adjacent to said print head sufficient for printing of a first image on said transfer surface;

a recording medium having a first face and a second face, transported along a medium path such that said print head allows for printing of a second image on said first face of said recording medium and said first image on said transfer surface is transferred to a second face of said recording medium by pressing said recording medium against said transfer surface; and a pressure roller for supporting said recording medium such that a pressure from said transfer roller is communicated through said recording medium to said pressure roller.

2. A printing apparatus comprising:

a print head responsive to digital signals;

a transfer surface positioned adjacent to said print head sufficient for printing of a first image on said transfer surface;

a recording medium having a first face and a second face, transported along a medium path such that said print head allows for printing of a second image on said first face of said recording medium and said first image on said transfer surface is transferred to a second face of said recording medium by pressing said recording medium against said transfer surface; and a platen positioned in apposition to said print head such that said platen is capable of supporting said recording medium during printing of said second image by said print head.

3. The printing apparatus of claim 2, further comprising a rotatably mounted transfer roller for mounting said transfer surface.

4. The printing apparatus of claim 2, further comprising a cleaning station for removing residue of said first image from said transfer surface.

5. The printing apparatus of claim 2, further comprising feed rollers for transporting said recording medium along said medium path.

6. The printing apparatus of claim 2, where said first image is printed on said transfer surface as a mirror image of how it is transferred to said medium.

7. The printing apparatus of claim 2, wherein said print head is the only print head in said printing apparatus.

8. A printing apparatus comprising:

a print head;

a transfer roller having a transfer surface;

a pressure roller; and a positioning mechanism for transporting a recording medium along a medium path such that at a first position along said medium path, said print head prints a first image on said transfer roller and at a second position along said medium path said print head prints a second image on a first face of a recording medium and at a third position along said medium path said transfer roller transfers said first image to a second face of said recording medium by pressing said recording medium between said transfer roller and said pressure roller.

9. The printing apparatus of claim 8, further comprising a platen which is positioned in apposition to said print head such that said platen supports said recording medium when said print head is printing said second image.

10. The printing apparatus of claim 8, further comprising a cleaning station for removing any residue of said first image from said transfer surface.

11. The printing apparatus of claim 8, further comprising feed rollers for transporting said recording medium along said medium path.

12. The printing apparatus of claim 8, where said first image is printed on said transfer surface as a mirror image of how it is transferred to said medium.

13. The printing apparatus of claim 8, wherein said print head is the only print head in said printing apparatus.

14. A printing apparatus comprising:

means for printing a first image on a transfer surface;

means for printing a second image on a first face of a recording medium; and means for transferring said first image from said transfer surface to a second face of said recording medium.

15. The printing apparatus of claim 14, further comprising a rotatably mounted transfer roller which attaches to and supports said transfer surface.

16. The printing apparatus of claim 14, further comprising a platen which is positioned in apposition to said print head such that said platen supports said recording medium when said print head is printing said second image.

17. The printing apparatus of claim 14, further comprising a pressure roller for supporting said recording medium such that a pressure from said transfer roller is transferred through said recording medium to said pressure roller.

18. The printing apparatus of claim 14, further comprising a means for removing any residue of said first image from said transfer surface.

19. The printing apparatus of claim 14, further comprising feed rollers for transporting said recording medium along said medium path.

20. The printing apparatus of claim 14, where said first image is printed on said transfer surface as a mirror image of how it is transferred to said medium.

21. The printing apparatus of claim 14, wherein said print head is the only print head in said printing apparatus.

22. A method for printing on two faces of a medium comprising the steps of:

printing a first image on a transfer surface;

printing a second image on a first face of a medium;

transferring the first image on said transfer surface to a second face of said medium by pressing said transfer surface against said second face of said medium; and cleaning said transfer surface.

23. The method for printing of claim 22, wherein said transfer surface is mounted on a transfer roller.

24. The method for printing of claim 22, wherein said printing of a first image further comprises the steps of:

printing an elongated part of said first image on said transfer surface while said transfer roller remains relatively stationary;

rotating said transfer roller approximately the height of said elongated part of said first image; and repeating the previous two steps until said first image has been completely printed.

25. The method for printing of claim 24, wherein said advancing of said medium is in a first direction.

26. The method for printing of claim 22, wherein said printing of said second image further comprises the steps of:

printing an elongated part of said second image on said recording medium while said recording medium remains relatively stationary;

advancing said medium to approximately the height of said elongated part of said second image; and repeating the previous two steps until said second image has been completely printed.

27. The method for printing of claim 26, wherein said advancing of said medium is in said first direction.

28. The method for printing of claim 22, said medium is transported in a single direction.

* * * * *